United States Patent [19]

Nason

[11] Patent Number: 4,517,932

[45] Date of Patent: May 21, 1985

[54] PAIRED BEAM ENGINES AND PUMPS

[76] Inventor: Martin L. Nason, P.O. Box 672, Rumford, Me. 04276

[21] Appl. No.: 425,285

[22] Filed: Sep. 28, 1982

[51] Int. Cl.[3] ..... F02B 75/06

[52] U.S. Cl. ..... 123/54 A; 123/56 AB; 123/197 AC

[58] Field of Search ..... 123/197 R, 197 A, 197 AB, 123/197 AC, 54 R, 54 A, 54 B, DIG. 1, DIG. 6, DIG. 7, DIG. 8, 56 AB, 56 BB

[56] References Cited

U.S. PATENT DOCUMENTS

| | | | |
|---|---|---|---|
| 1,380,404 | 6/1921 | Miller | 123/54 R |
| 1,625,835 | 4/1927 | Sutton et al. | 123/197 R |
| 2,067,049 | 1/1937 | Goldberg | 123/51 BB |
| 2,112,829 | 4/1938 | Colburn | 123/54 R |
| 2,500,823 | 3/1950 | Hickey | 123/48 B |
| 2,684,053 | 7/1954 | Perdelli | 123/54 A |
| 2,911,964 | 8/1955 | Prescott et al. | 123/54 B |
| 3,369,733 | 2/1968 | Campbell | 123/46 R |
| 4,092,957 | 6/1978 | Tryhorn | 123/48 B |
| 4,274,367 | 6/1981 | Gerber et al. | 123/54 A |

FOREIGN PATENT DOCUMENTS

| | | | |
|---|---|---|---|
| 0160080 | 12/1954 | Australia | 123/54 R |

*Primary Examiner*—William A. Cuchlinski, Jr.
*Assistant Examiner*—David A. Okonsky

[57] ABSTRACT

The engines may be of either the swing beam or the rocker beam type and each has its crankshaft in a central, transverse plane of the block. Each engine has at least one pair of cylinders with each having a piston and a head. A link pivotally connected to each piston is connected to the appropriate one of a pair of beams, one on each side of the central plane and each pivotally connected to the block. Each beam is pivotally connected to the appropriate one of the crankshaft connecting rods. The moving paired parts, i.e. the pistons, links, beams and connecting rods, are so formed and positioned with reference to the central transverse plane that a plane inclusive of any feature of the moving parts and the crankshaft axis defines an angle with respect to a plane inclusive of the corresponding feature on the opposite side of the central plane and the crankshaft axis that does not exceed ±4° and the perpendicular radial distance between corresponding features of the moving parts and the crankshaft axis differ by no more than ±8%. The working surfaces of the block constraining the motion of the moving parts are subject to the same limitations. The moving parts on each side of the central plane may be axially aligned or axially offset. In all embodiments of the invention, the crankshaft axis is an axis of symmetry and the engine possesses effective dynamic balancing properties.

10 Claims, 20 Drawing Figures

5
U
120
21
20
28
42
29
47
R
3
3
45
27
43
23
46
R
R'
2
2
48
30
26
24
31
40
41
39
36
R'
25
46
32
27
37
38
34
21
28
5
U 46
24
48
20
23
51
20
50
46
27
27
45
45
49
51
50
26
43

29B
28B
U
10
58
47B
45B
R
46B
55
26B
62
42B
R'
R
43B
23B
8
8
24B
41B
65
63
40B
64
R'
27B
39B
36B
34B
27B
38B
37B
54
32B
28B
10
U 54
23B
56
59
55
24B
24B
27B
27B
57
45B
45B
62
26B
62
46B
55
60
56
61
43B

PAIRED BEAM ENGINES AND PUMPS

PRIOR ART

U.S. Letters Pat. No. 1,625,835
U.S. Letters Pat. No. 2,067,049
U.S. Letters Pat. No. 2,500,823
U.S. Letters Pat. No. 2,911,964
U.S. Letters Pat. No. 3,369,733
U.S. Letters Pat. No. 4,092,957
U.S. Letters Pat. No. 4,274,367

BACKGROUND OF THE INVENTION

Many different internal combustion engines have been proposed utilizing in the power trains beams pivotally connected to their blocks.

In one type, the swing beam type, one end of each beam is connected to the block with its other end connected to the piston by a link and with a connecting rod pivotally connected to an intermediate portion of the beam. In the other type, the beams are connected to the blocks between their ends and with the opposite end of each connected, respectively, to a connecting rod and a piston link.

In spite of the addition of beams to their power trains, both types of beam engines offer certain advantages over conventional internal combustion engines of both the two and four cycle types that have been recognized in connection with earlier proposals as will be apparent from a discussion of the previously listed prior art. Among these, there are two of particular interest in that they are common to both swing and rocker beam engines. One of these is that due to the employment of links between the beams and pistons, cylinder wall wear is minimized. Another advantage is that the construction of beam engines necessarily place their combustion chambers closer to the crankshafts than is possible with conventional engines with the result that with respect to the intake and exhaust of fluids, greatly shortens valve operating trains and cylinder ports to crankcase connections. Other desirable features that are attainable in the case of swing beam engines are increased combustion time per crankshaft revolution or engine cycle and the advantage that the crankpin throw is decreased in relation to a total piston stroke.

PRIOR ART STATEMENT

The previously listed United States patents are the only prior art known to me relevant to the present invention.

Of these, U.S. Pat. No. 1,625,835 disclosed an engine of the rocker beam type having a separate pair of piston cylinder units, each provided with a separate head with its piston connected to a rocker beam. Both rocker beams are connected to a common crankshaft. Both piston-cylinder units were located, however, on the same side of the crankshaft axis.

U.S. Pat. No. 2,067,049 disclosed an internal combustion engine utilizing pairs of beams with a pair of opposed pistons in each cylinder with corresponding pistons of both cylinders connected to opposite ends of the appropriate one of the beams. The engine was workable only for a minimum of two pairs of pistons.

U.S. Pat. No. 2,500,823 disclosed an engine of the type having a pair of pistons within each cylinder with each piston connected to a particular one of the rocker beams. Means are disclosed to vary the compression ratios by changing the pivot axes of the beams.

In U.S. Pat. No. 2,911,964 an engine is shown that is generally similar to that shown in U.S. Pat. No. 2,067,049 except that each piston is connected to a separate rocker beam and is subject to the same limitation that at least two pairs of pistons are necessary.

U.S. Pat. No. 3,369,733 disclosed an engine utilizing opposed pistons in a common cylinder with each piston connected to a swing beam and the axis of each beam adjustable to vary the compression ratios.

In U.S. Pat. No. 4,092,957, the disclosed diesel engine utilized features such as the use of an eccentric pivot for the beams to allow variations in compression ratios and a design allowing increased combustion time per revolution as compared to conventional internal combustion engines and decreased crankpin throw.

In U.S. Pat. No. 4,274,367, an engine utilized a pair of cylinders with each provided with opposed pistons with the pistons of each connected to opposite ends of a common rocker beam having spaced connections, one for each of two crankshafts.

THE PRESENT INVENTION

The general objective of the present invention is to provide expanding chamber machines of the swing and rocker beam types having features that are directed to both manufacturing and operating advantages. While the machines may be pumps or compressors, they are herein discussed primarily as internal combustion engines.

In brief, this objective is attained with an engine of either type with its block supporting a crankshaft the axis of which establishes a transverse plane that is preferably centrally of the block. The block is provided with at least one pair of cylinders, each containing a piston and provided with a separate head with the combination sometimes referred-to as a piston-cylinder unit. A separate beam for each such unit is pivotally connected to the block on opposite sides of the transverse plane with each beam pivotally connected by a link to the appropriate one of the pistons and to the appropriate one of the crankshaft connecting rods with such moving parts often herein referred-to as power trains. The engine may consist of one pair of such power trains, sometimes referred-to as a one paired beam engine, embodiments of which are illustrated by the drawings, or multiple pairs of such power trains illustrated by the drawings by four cylinder engines sometimes herein referred-to as two paired beam engines.

In order that the term "feature" as used herein, may have definite meaning, it is defined as a mass element of one of the moving parts in the power trains, a mass centroid of one of such moving parts, a combined mass centroid of two or more moving parts, a moving pivot axis associated with a part in the power train, or it may be a point of a working surface of the block structure. Such working surfaces are those which constrain or control the motion of the moving parts of the power train and there are three such surfaces, the cylinder walls, the beam pivot support surfaces in the block and the crankshaft bearing support surfaces.

The term "power train" includes moving pistons, links, beams, connecting rods, crankshaft, and the several pivots, and the term "pair" means the elements thereof that become corresponding features.

A major objective of the invention is to establish corresponding components of power trains on opposite sides of the transverse plane as balanced pairs so constructed and positioned that a plane inclusive of any features of one power train and the crankshaft axis defines an acute angle with respect to a plane inclusive of the crankshaft axis and the corresponding features of the opposite power train that does not exceed ±4° and the perpendicular radial distance between corresponding features of the power trains and the crankshaft axis differ by no more than ±8% thus creating an axis of symmetry for the moving parts of the power trains substantially coincident with the crankshaft axis. With an engine utilizing both the above block and power train limitations, engine dynamic balancing properties are achievable to an extent not previously possible to attain.

Another objective of the invention is to provide an axially symmetric engine block with working surfaces controlling and constraining the motion of the moving parts in the power train and so constructed that a plane including any such feature of the block and the axis of symmetry defines an acute angle with reference to another plane inclusive of the corresponding block feature and the axis of symmetry on the opposite side of the axis of symmetry that does not exceed ±4° and the perpendicular radial distance between corresponding block features and the axis of symmetry do not differ by more than ±8%. In accordance with the invention if there is no axial offset of the features with respect to the corresponding features along the axis of symmetry, then the points on the working surfaces of that portion of the block on the right hand side of a central transverse plane can be matched with the points on the corresponding working surfaces of the block portion on the left hand side of the central plane by a 180 degree rotation of the right portion or the left portion about the axis of symmetry. Such block portions or halves having this block property is defined and will be referred to herein as identical block halves. If there is an axial offset of the features relative to the corresponding features of the block along the axis of symmetry then the block halves are non-identical.

An objective of the invention is to show how the complete engine crankcase, cylinders and heads can be cast as a one piece block or as a two piece block. When the block halves are identical, then the pieces of the two piece block can be cast as two substantially identical pieces thereby allowing the heads, cylinders and crankcase of a multiple cylinder engine block to be formed with only one basic casting.

An objective of the invention is to provide an axis of symmetry of the block for the one paired beam engine about the crankshaft axis and to allow either axially aligned or axially offset cylinders to be utilized with either one rod for each beam or two light rods flanking one beam and one heavy rod connected to the other beam with simultaneous dynamic balance of the block reaction forces due to the motion of moving parts in the power train.

Another objective of the invention is to provide a two pair beam engine in which the combined motion of the two pairs is perfectly balanced with respect to the dynamic block reaction forces and moments of the moving parts in the power trains acting thereon, an objective attained with each pair connected to a separate, centrally positioned crankshaft with the crankshafts geared together and rotating in opposite directions at equal rates and so synchronized as to achieve that objective.

A further objective of the invention is to provide a two pair beam engine in which the dynamic reaction forces are perfectly balanced and the dynamic reaction moments of the moving parts of the power trains are approximately balanced.

Yet another objective of the invention is to provide two paired beam engines the blocks of which consist of identical halves whether the axes of each opposite pair of cylinders are axially aligned or offset. In accordance with the invention, this objective is attained by providing a block with an axis of symmetry about an axis normal to the crankshaft axis and with such axis also within the central transverse plane inclusive of the crankshaft axis when incorporated in the block.

Other objectives of the invention and the manner by which they are attained will be apparent from the accompanying drawings, specification and the appended claims.

BRIEF DESCRIPTION OF THE DRAWINGS

The accompanying drawings illustrate preferred embodiments of the invention of which.

THE PREFERRED EMBODIMENTS OF THE INVENTION

Figure 1:
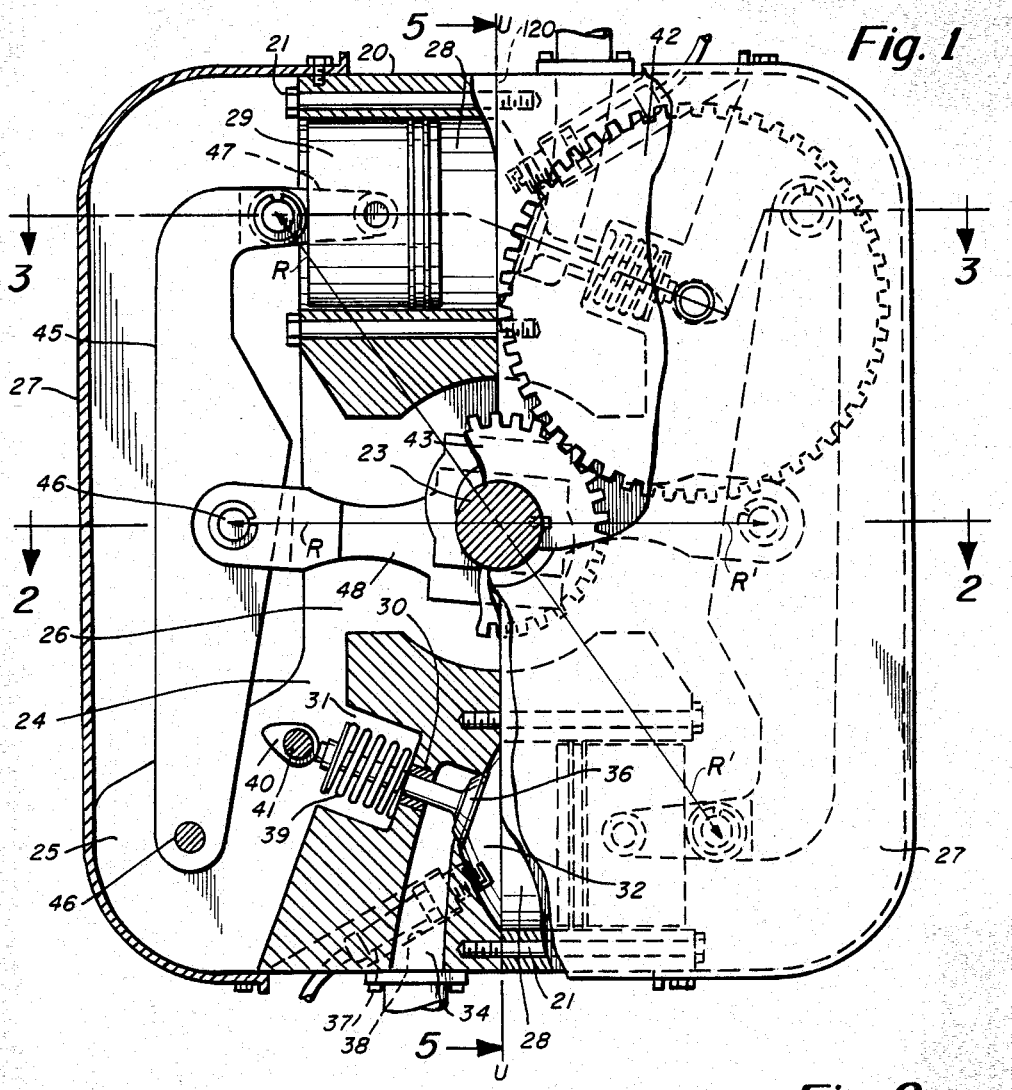
FIG. 1 is a partly sectioned end view of an internal combustion, four cycle engine of the swing beam type in accordance with the invention.
Figure 2:
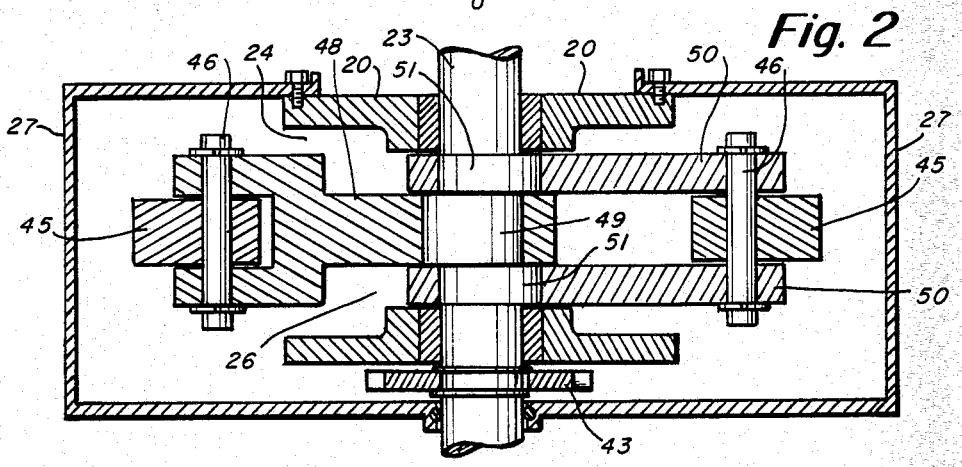
FIG. 2 is a section taken approximately along the indicated line 2—2 of FIG. 1.
Figure 3:
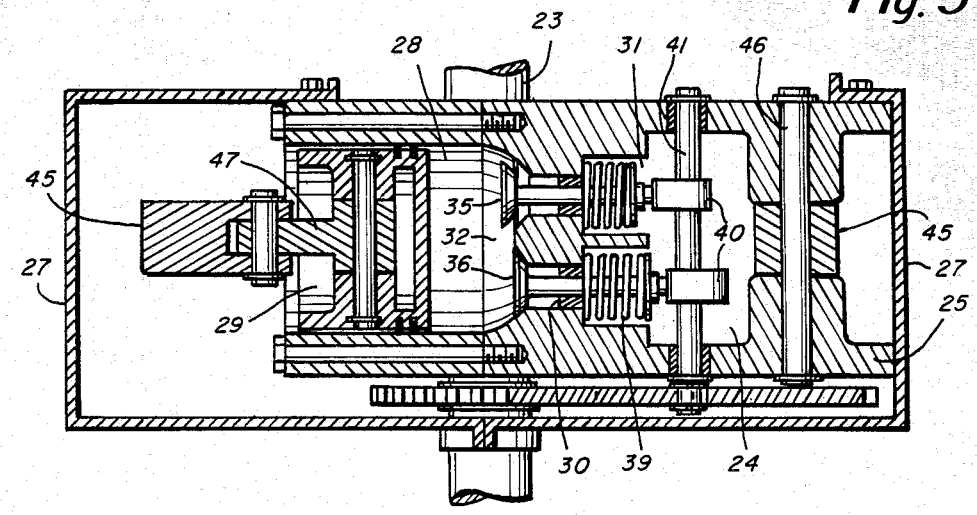
FIG. 3 is a section taken approximately along the indicated line 3—3 of FIG. 1.

Before describing the invention in detail in connection with internal combustion engines illustrated by FIGS. 1-10, it is to be noted that each is, for convenience, a one paired beam engine with ignition, fuel delivery and exhaust systems omitted to simplify the drawings as such systems are well known to those skilled in the art and form no part of the present invention.

The four cycle engine illustrated by FIGS. 1-3, 5, and 6 has an engine block consisting of two identical half sections 20 with one turned 180° relative to the other and with the two sections having their mating faces united by bolts 21 and having their proximate faces provided with complemental, transverse, bearing lined, arcuate recesses 22 for the crankshaft 23.

The outer or opposite portion of each section 20 has a channel 24 dividing a projection 25 at one end thereof and opening into a central passageway 26 which opens through its mating face. The outer portion of each section is closed by a detachable pan or cover 27. A bore 28 adjacent the opposite end of each block section 20 constitutes a cylinder for a piston 29, and the cylinder axes are in a common plane normal to the crankshaft axis.

Adjacent the outer end of each channel 24 there are bushing lined bores 30 each effecting communication between the appropriate one of the counterbores 31 and a recess 32 in the mating face of that section which recess is disposed and dimensioned to constitute the cylinder head for the cylinder 28 of the mated section 20. Intake and exhaust ports 33 and 34, respectively, which open through the proximate end of the block section, are in communication with the cylinder head recess 32 which is provided with seats for valves 35 and 36. A spark plug 37 for each cylinder 28 is threaded into a counterbored socket 38 opening outwardly from the cylinder head.

The stems of the valves 35 and 36 extend through the appropriate one of the bushing lined bores 30 and through valve springs 39 conventionally confined in the counterbores 31. The ends of each of the valve stems is in engagement with the appropriate one of the cams 40 mounted on an overhead cam shaft 41 journalled in the walls of the channelled projection 25 transversely of its channel 24. The cam shafts 41, although they may be connected to the crankshaft 23 by belts or chains, are shown as having gears 42 in mesh with a gear 43 on the crankshaft 23. The gears 42 and 43, in this embodiment of the invention, are externally of the assembled block and within a housing 44 attached thereto rather than within the assembly which would then require thicker castings. A two cycle engine, otherwise identical to this embodiment of the invention would have appropriate gears and port arrangements.

Each section 20 has a beam 45 connected to the walls of the channelled projection 25 by a transverse pivot 46 and is pivotally connected at its other end to a link 47 which is pivotally connected to the associated piston 29. An intermediate portion of each beam 45 is connected to the appropriate crankpin of the crankshaft 23 through the appropriate one of the passageways 26. Because of the arrangement of the beams in the power train, the engine is of the swing beam type. In the case of one section 20, see FIG. 2, a single connecting rod 48 connects a beam 45 to one crankpin 49 and in the case of the other section, the swing beam 45 thereof is connected by a pair of connecting rods 50, one on each side of the crankpin 49, to the narrower crankpins 51, an arrangement necessary because the axes of the cylinders 28 are in the same plane normal to the crankshaft 23 and in order that their mass may be equal to that of the connecting rod 48.

It will be seen that the axis of the crankshaft 23 is in the central transverse plane 120 of the engine, the plane between the two block sections 20. In addition, it will be seen that any plane, inclusive of any feature of any of the moving parts of the power train on one side of the central transverse plane and the crankshaft axis intersects the corresponding feature of the corresponding moving part on the opposite side of that plane, thus establishing ideal balancing properties.

It will also be noted, that with the block shown, that any plane inclusive of any feature of an interior working surface of one block section 20 and the crankshaft axis intersects the corresponding feature of the other block section 20 and the crankshaft axis. These working surfaces are cylinder walls, beam pivot support surfaces, and the crankshaft bearing support surfaces, that is, working surfaces which constrain and control the moving parts of the power train.

As has been noted earlier, ideal relationships between the moving parts and between corresponding parts of the block with reference to central transverse planes inclusive of the crankshaft axes are sometimes sacrificed for one reason or another. In the case of the moving parts, excellent balancing properties are still obtainable provided that planes between corresponding features on opposite sides of the plane 120 and which include the axis of the crankshaft 23 define acute angles which do not esceed ±4° and that the perpendicular radial distances between the same corresponding features and the crankshaft axis differ by no more than ±8%. angle between corresponding features and the crankshaft axis that does not exceed ±4° and the radial distance between corresponding working surfaces of the block and the central transverse plane differs by no more than ±8%.

Figure 4:
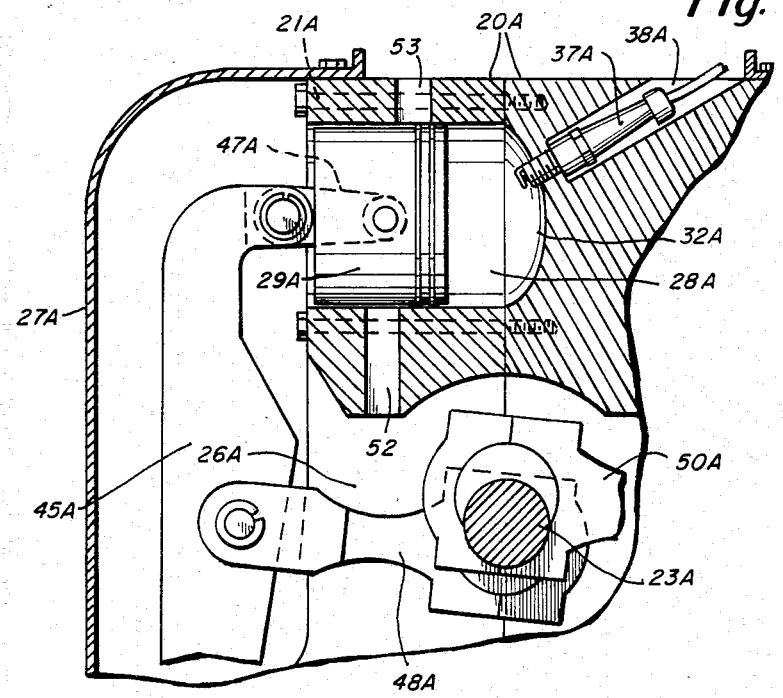
FIG. 4 is a fragmentary section of the piston-cylinder portion of a block of a two cycle swing beam engine which is otherwise generally similar to that of FIGS. 1–3.
Figure 5:
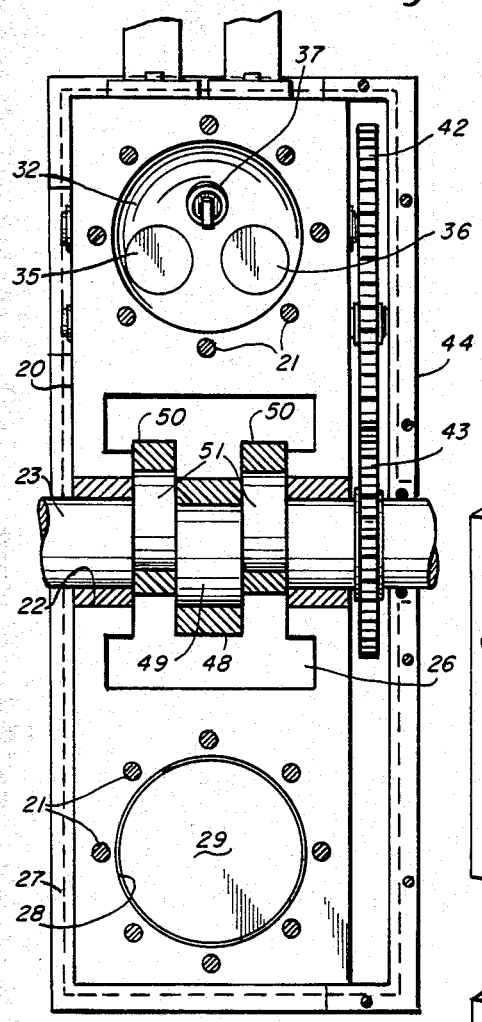
FIG. 5 is a section taken approximately along the indicated line 5—5 of FIG. 1.
Figure 6:
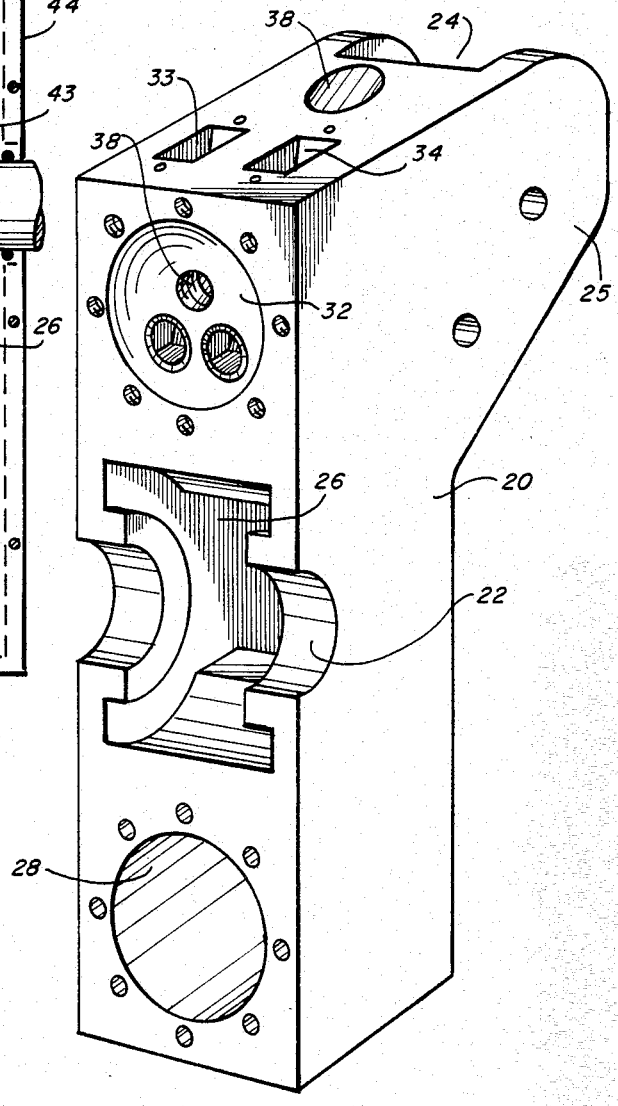
FIG. 6 is a perspective view of one of the two identical block halves of the engine of FIG. 1.
Figure 7:
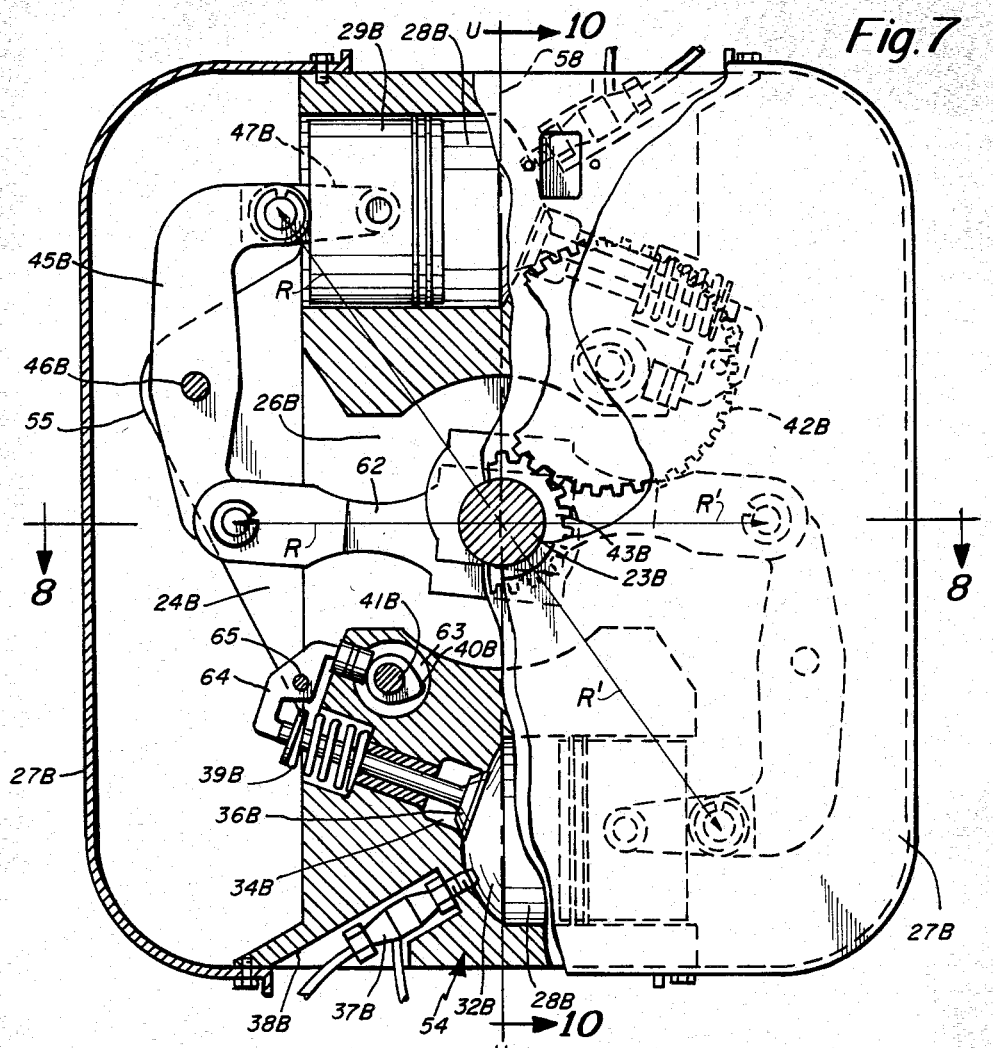
FIG. 7 is a view similar to FIG. 1, illustrating a four cycle, rocker beam engine in accordance with the invention.
Figure 8:
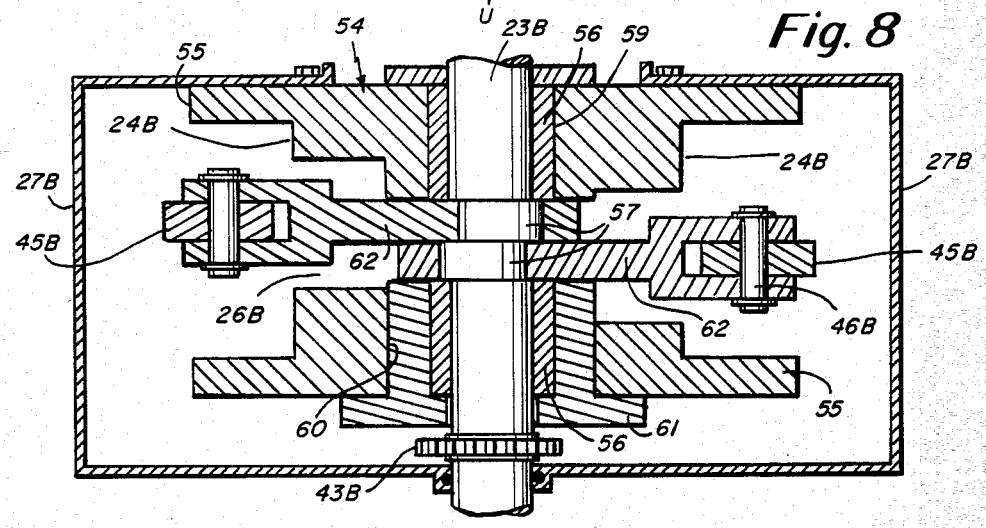
FIG. 8 is a section taken approximately along the indicated lines 8—8 of FIG. 7.
Figure 9:
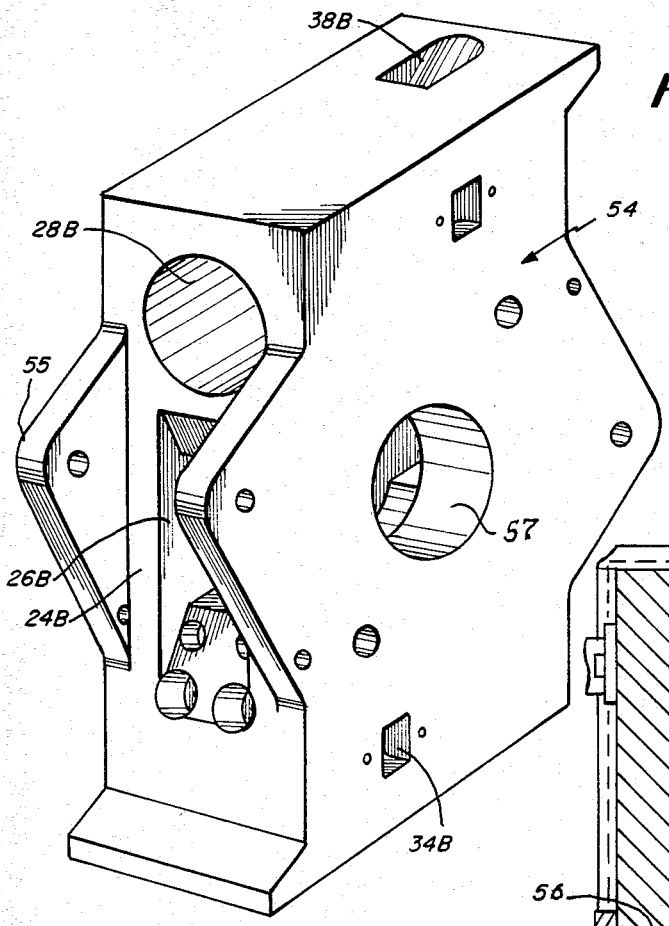
FIG. 9 is a perspective view of the one piece block.
Figure 10:
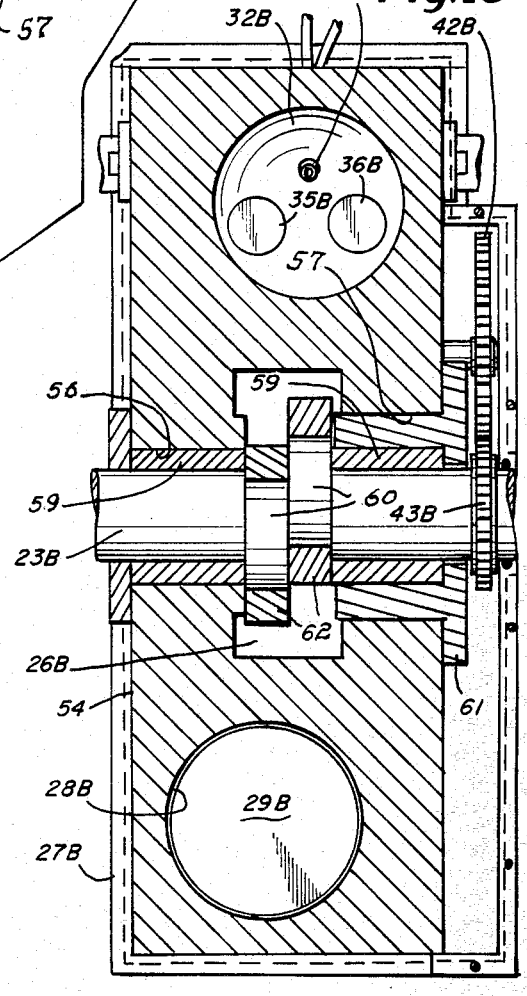
FIG. 10 is a section taken approximately along the indicated line 10—10 of FIG. 9 with the crankshaft installed.

In FIG. 4, only a fragment of a two cycle engine is shown as it may be identical to the previously described engine except for the intake port 52 and the exhaust port 53. Ports that correspond to those of previously described engines are identified by the corresponding reference numerals distinguished by the suffix addition "A".

The intake and exhaust ports 52 and 53 open into each cylinder 28A through the walls thereof with only the spark plug 37A in the cylinder head. The intake port 52 is below the exhaust port 53 with respect to the cylinder head and opens into the crankcase as is conventional with two cycle engines of the crankcase compression or pump intake types. A block such as that described but for use with the intake coming from an external source such as a pump or compressor could be identical except that the port 52 would then also open outwardly through the cylinder wall below the port 53.

The embodiment of the invention illustrated by FIGS. 7–10 is generally similar to that of FIGS. 1–3, 5, and 6 and, accordingly, it will not be described except as to features that differ. Common features are identified by the same reference numerals distinguished, however, by the suffix addition "B".

A one piece block 54 has a channel 24B dividing a projection 55 on opposite faces and opening into a central passageway 26B interconnecting the channels 24B. The block 54 has ports 56 and 57 the axes of which are in a central transverse plane 58. The port is dimensioned to accommodate the crankshaft 23B and its bearing 59 while the port 57 is sufficiently larger to permit the crankpins 60 to be entered therethrough. A flanged insert 61 is dimensioned to seal the port 57 and be bolted to the block 54 and to receive the crankshaft 23B and a bearing 59.

The power trains differ from those previously described in that the beams 45B are shorter and each is supported in the appropriate channel 24B by a centrally located pivot 46B by the walls of the appropriate projection 55 with one end pivotally connected to the associated piston link 47B and the other end pivotally connected to the appropriate one of the identical connecting rods 62. The connecting rods 62 may be identical as the axes of the cylinders 28B are in planes that, while normal to the crankshaft axis, are axially offset with respect thereto.

The cam shaft 41B for each cylinder 28B is journalled in the block 54 and extends freely through a bore 63 located between the associated bore 31B and the central passageway 26B and relatively near the latter. Rocker arms 64 for each cylinder 28B are pivotally supported by the walls established by the channel 24B with their ends in engagement with the appropriate one of the stems of the valves 35B and 36B and the appropriate one of the cam actuated pushers 65. The cam shafts 41B are shown as provided with gears 42B in mesh with a crankshaft gear 43B, in lieu of belts or chains and are selected for four cycle operation.

The engine thus described is a rocker beam engine and with changes required for different gears and port arrangements is also well suited for two cycle engines.

It will be noted that the engine of FIGS. 7–10 possesses the same characteristics as the previously described engine with respect to the relationship between features of the power trains of the working surfaces of the block on opposite sides of the central transverse plane 58 that ensure excellent dynamic force balancing properties. It should be noted that the portion of the unitary block 54 shown on FIGS. 7 and 9 to the right of the central transverse plane 58 cannot be rotated 180 degrees about the crankshaft axis so as to match the points on the working surfaces of the right hand portion with the corresponding points on the working surfaces of the other portion of the unitary block 54 on the left on the central transverse plane 58 due to the axial offset along the crankshaft axis of the pair of cylinders 28B shown on FIG. 10. As a consequence, these two portions or halves of the unitary block are non-identical portions or halves. If the cylinders 28B are aligned within the unitary block then corresponding features can be matched and identical block halves would result.

Figure 11A:
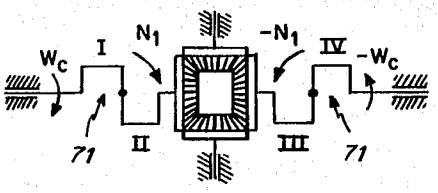
FIG. 11A is a schematic view of a crankshaft for use in the engine of FIG. 11 when each two paired beam engine is of a type in which the axes of the cylinders are axially offset relative to the crankshaft.
Figure 12A:
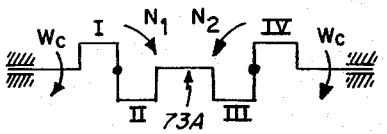
FIG. 12A is a schematic view of a crankshaft for the engine of FIG. 12 where the axes of the cylinders are offset relative to the crankshaft axis.
Figure 11:
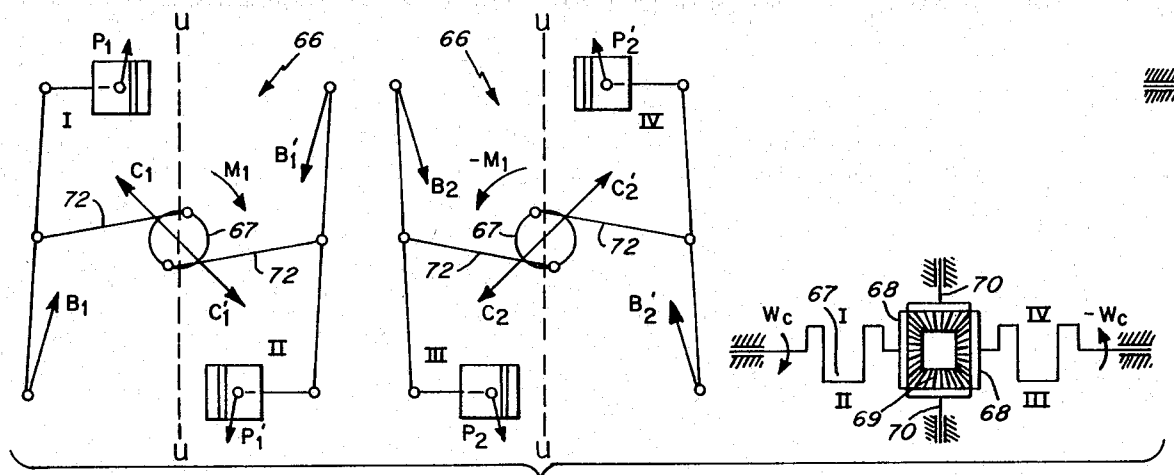
FIG. 11 is a schematic view of two one paired beam engines combined by a gear connection between their crankshafts to establish a two paired beam or four cylinder engine, the one paired beam engine and crankshaft shown, however, side-by-side to enable their relationship and functioning to be more readily compared.
Figure 12:
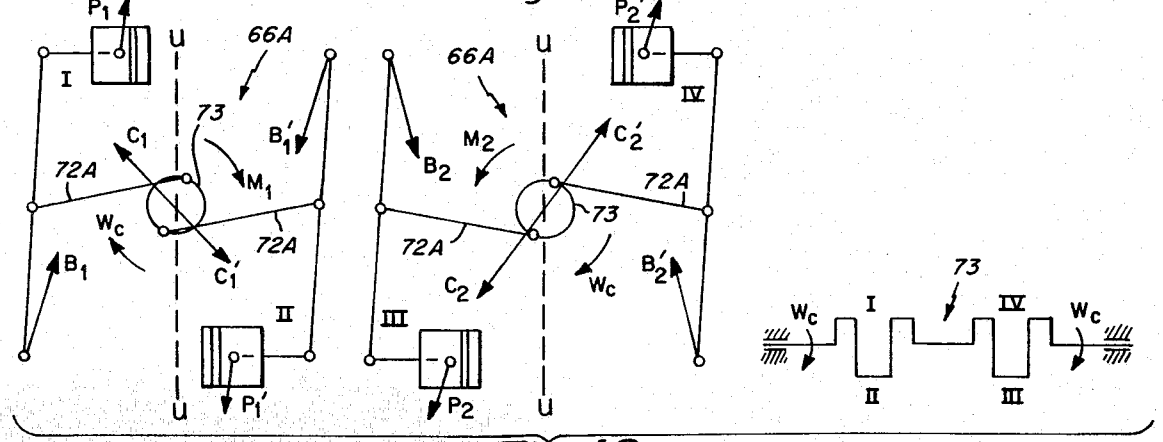
FIG. 12 is a view generally similar to FIG. 11 but illustrating a two paired beam engine having a single crankshaft.
Figure 13:
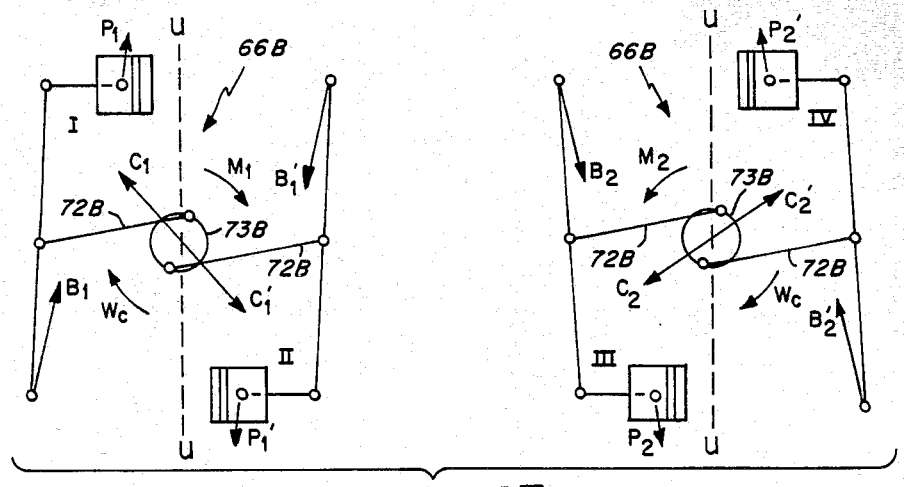
FIG. 13 is yet another view of a two paired beam engine, the view generally similar to FIGS. 11 and 12 but with the pistons connected to the crankshaft in a different manner.

Of much interest and practicality is the dynamic balance of the moving paired parts of the engine in the power train, the paired parts consisting of the pistons, links, beams, and connecting rods. Viewed as a connected group of paired mass elements, then the block reaction forces of these paired moving parts and crankshaft will appear at the three points of contact between the power train components and the engine block. These are (1) the crankshaft bearing support forces on the crankcase, (2) the beam pivot reaction forces on the block, and (3) the piston forces on the cylinder walls. In the analysis to follow, these forces will be assumed to always act in pairs. It is to be further understood that these forces are the dynamic reaction forces due to accelerated reciprocating motion of the moving power train mass elements and thus do not include the combustion pressure forces. The friction force between the pistons and the cylinder walls can be included when the friction forces of a pair are equal and oppositely directed paired forces, which occurs when the pistons are moving at the same velocity and are at the same position in the cylinders. FIGS. 11, 12 and 13 illustrate these paired forces by the vectors P, $P^1$, C, $C^1$ and B, $B^1$. Subscripts 1 and 2 are used to distinguish between the forces of the first pair and the second pair respectively for the two paired beam engines shown thereon. It is to be understood that the relative magnitudes and directions for these forces are time variable and cylical, even assuming constant angular velocity of the crankshaft with no firing pulses of the combustion chambers formed by the pistons, cylinders and heads. That is, assuming that the engine for a single pair of beams is assembled with each component of a pair, pistons, links, rods and beams, similar and that they are positioned similarly on the opposite sides of the central transverse plane of the block, then the paired forces are force vector pairs equal in magnitude but opposite in direction, although only the crankshaft forces are necessarily collinear.

The crankshaft rotational axis of the described engines is an axis of symmetry. This causes the forces on opposite sides of the central transverse plane to be equal in magnitude and opposite in direction and to have the same perpendicular distances between the crankshaft axis and the line of action of the forces. This condition not only requires similar components in the power train on opposite sides of the central plane, but the connecting rods have to be attached to separate crankpins angularly positioned at exactly 180° apart on the crankshaft and the cylinders and beam pivot axes must be similarly positioned in the block halves as well. When these conditions are met, then either side of the engine relative to the central plane is a dynamic equivalent to the engine half on the opposite side of the plane. And further, either side of the engine including the reaction forces can be transformed into the other side by a 180° angular rotation about the axis of symmetry or the crankshaft rotational axis. It should be understood, however, that the engine will perform and operate if these conditions are not met exactly and in many embodiments of this engine concept these conditions need not be imposed precisely but the general arrangements retained with quite acceptable performance with such performance being superior as regards the dynamic balance relative to existing two and four piston-cylinder beam engines now in use provided that the two critical limitations are not exceeded; namely, that planes inclusive of the axis of the crankshaft 23B and corresponding features define acute angles that do not exceed ±4° and that the perpendicular radial distance between the same corresponding features and the crankshaft axis differ by no more than ±8%. inclusive of any feature of any moving part on one side of the central transverse plane and the crankshaft axis and the corresponding feature on the opposite side of the plane does not define an angle that exceeds ±4° and that the perpendicular radial distance between said features does not differ by more than ±8%.

Figure 17:
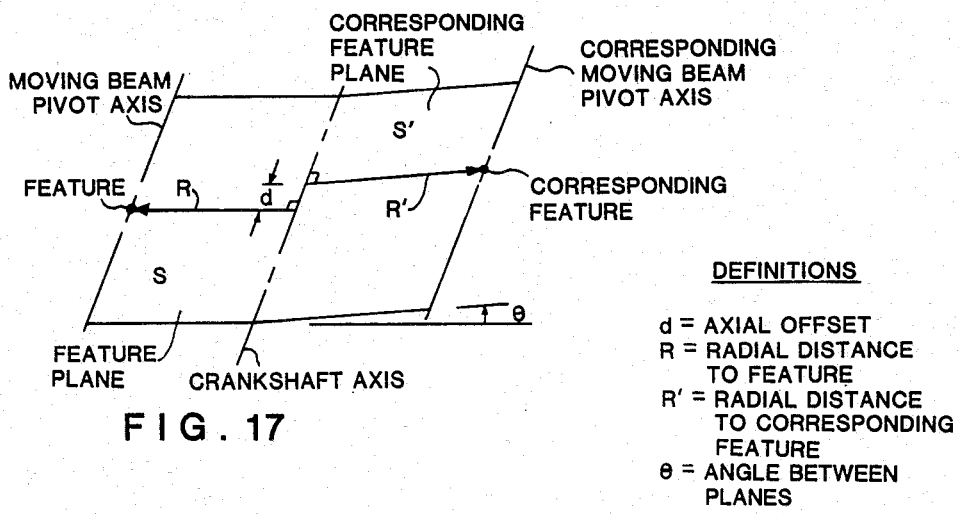
FIG. 17 is a diagramatic view defining the parameter chosen to describe the axial symmetry of the moving parts with respect to the crankshaft axis.

In FIG. 17 each of the transverse planes S and $S^1$ includes one of the two corresponding features such as the moving beam pivot axes. The acute angle between these planes and the perpendicular radial distances R and $R^1$ within these planes shown thereon describe analytically the positions of the corresponding features relative to the crankshaft axis. Analogously block features symmetrical to an axis normal to the crankshaft axis can be described similarly by substitution of the normal axis for the crankshaft axis and points on the working surfaces for the moving beam pivots axes illustrated on FIG. 17.

Figure 18:
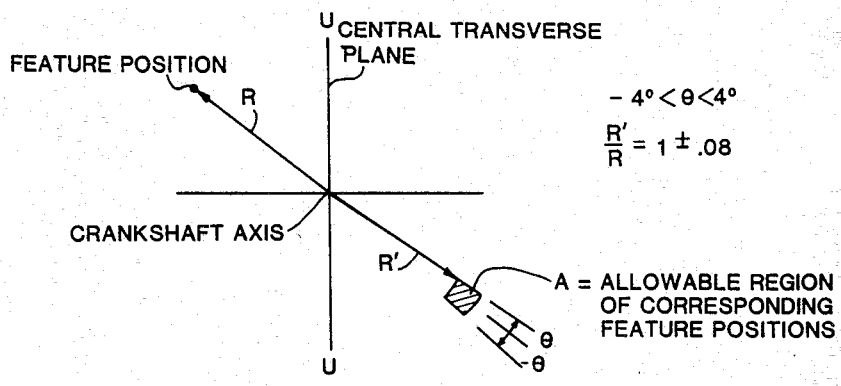
FIG. 18 is a diagramatic view showing the allowable limits permissable with respect to perfect axial symmetry.

In FIG. 18 the mathematical limits on the parameters which determine the allowable region A for the corresponding feature positions relative to the feature position are shown. The angular limit set on the acute angle between the planes S and $S^1$ is ±4° and the perpendicular radial distances with respect to the axis of symmetry (or crankshaft axis) may not differ by more than ±8%. The line U is indicative of a central transverse plane such as planes 120 and 58 inclusive of the crankshaft axis but are separate from the transverse planes S and $S^1$ inclusive of corresponding features on opposite sides of the plane U. FIG. 18 has been drawn to scale so as to show the correct size of the allowable region A; that is, the angles and radial distance ratios indicated are consistent with the stated limits on axial symmetry.

Assuming, in the previously described one paired beam engines that the crankshaft axis is an axis of symmetry, then the vector sum of all the paired forces vanishes and the forces become perfectly dynamically balanced. Since the crankshaft rotational axis is an axis of symmetry, then the centroid of all the moving parts in the power train including the pairs of pistons, links, beams, rods and the crankshaft is fixed on the crankshaft axis of symmetry. Therefore, the sum of the external forces vanishes. It is to be emphasized here that this condition does not imply that there are no external forces acting on the system or that no block reaction forces exist or that there are no internal forces between the parts in the power train, since these forces will exist and be finite. The axial symmetry condition only causes the sum of all the external forces to vanish, which is a sufficient condition for perfect balance of all block reaction forces due to the motion of the pair of beams and associated other parts in the power train.

The dynamic forces of the moving parts acting on the block produces a reaction torque or moment about the crankshaft axis that is unbalanced and is finite in magnitude but variable even with perfect balance of the pairs of forces although always coincident with the crankshaft axis. If the cylinders are in axially offset planes with respect to the crankshaft axis, then an additional unbalanced moment normal to the crankshaft is created which, in general, is time variable in magnitude and its axis in space is also variable in direction, but it is confined and located within the plane midway between the two planes of motion of the opposite components in the power trains.

It should be noted that the two pistons of the previously described engines must reach top dead center within their respective cylinders and combustion chambers simultaneously if perfect force balance is desired. In a two cycle engine each cylinder must be fired once every revolution of the crankshaft, therefore the engines, if operated in a two cycle mode, must fire the two cylinders simultaneously. If the piston-cylinders are fired together and if there is no axial offset along the crankshaft axis, then theoretically there will not only be a balance of the crankshaft dynamic reaction forces on the main crankcase bearings supporting the crankshaft, but the crankshaft driving torque due to the combustion chamber pressure forces transmitted thereto will be a pure driving torque or couple and there will be a complete unloading of the lateral bearing forces during engine operation. This is a very useful and significant result. Much of the noise and vibration in an internal combustion engine is caused by the hammering of the crankshaft on the bearings supporting it within the crankcase cavity. This unloading of the lateral bearing forces on the crankcase does not occur if the piston-cylinder units of the pair are fired separately or if there is an axial offset of the moving parts as with the rod and crankshaft system shown in FIG. 8.

If the previously described paired beam engines are operated as four cycle engines, then either (a) both the cylinders are fired together every other revolution of the crankshaft or (b) each unit of the pair is fired separately and alternately once every revolution so as to complete the cycles in two revolutions of the crankshaft as required in a four stroke engine configuration.

Figure 14:
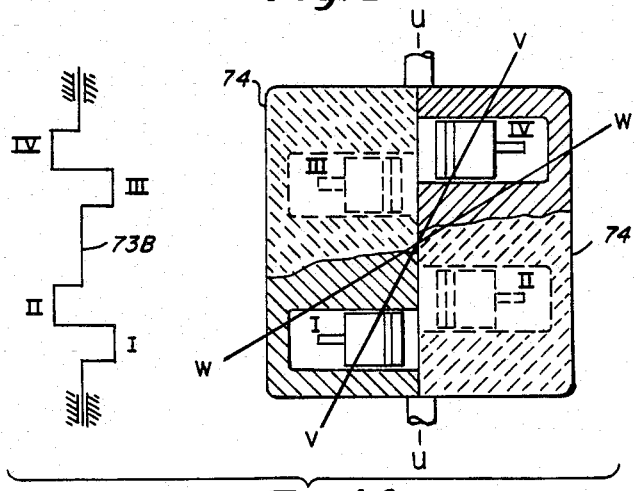
FIG. 14 is a schematic view of an engine of the two paired beam type having its block consisting of identical halves with the axes of all cylinders spaced from each other relative to the crankshaft axis.
Figure 16:
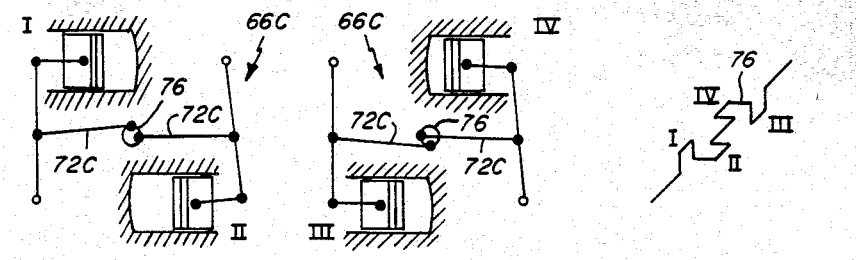
FIG. 16 is yet another like view of another two paired beam engine having individual crank pins angularly spaced 90° apart on the crankshaft.

Two one paired beam engines may be assembled in various ways whether they are rocker or swing beam engines. For convenience and for easier comparison, the two paired or four cylinder beam engines illustrated by the drawings are all of the swing beam type and in all embodiments, the two cylinders of one such engine are identified by the Roman numerals I and II and those of the other engine by the Roman numerals III and IV. In FIGS. 12, 14, and 16, the two coupled engines are identical but not necessarily dynamically equivalent but with the second engines of each so disposed relative to the first engine as if turned through 180° so that the axes of the cylinders I and IV are in a plane as are the axes of the cylinders II and III the two planes parallel and on opposite sides of the crankshaft.

In the case of the engine of FIG. 11, the identical swing beam engines 66 have their respective crankshafts 67 provided with bevel gears 68. Each bevel gear 68 meshes with bevel gears 63 on shafts 70. By this or other equivalent gear trains such as spur or gear train, the crankshaft velocity of one engine 66 is reversed relative to that of the other so that either crankshaft can be the drive shaft. If the thus connected engines have their pistons so synchronized that they reach top deed in their respective cylinders simultaneously, the motion of the four power trains is dynamically equivalent and the block reaction motions are balanced, equal but opposite moments. The crankshaft 67 are for use where the axes of the cylinders of each engine are in alignment in a common plane while the crankshafts 71 of FIG. 11A are for use when such axes are offset axially with respect to the crankshaft axes.

The four cylinder engine of FIG. 11, if operated as a two cycle engine, must have all four cylinders fired simultaneously, once every revolution of the crankshaft. If the engine is operated as a four cycle engine, two cylinders must be fired together during the next revolution thereof. In FIG. 11, the connections of the connecting rods 72 to the crankshafts 67 are shown schematically as so located as required for such operations.

In the two paired, four cylinder beam engine, schematically illustrated by FIG. 12, the engines 66A include a common crankshaft 73 and as a consequence the engine is only force balanced. With the indicated connections of the connecting rods 72A to the crankshaft 73, pistons I and II and also pistons III and IV reach top dead center a half revolution of the crankshaft apart and thus the firing pulses are more evenly distributed than in the case of the engine of FIG. 11. If the engine of FIG. 12 is operated as a four cycle engine, each of the four cylinders can be fired separately, thus evenly and one-half a crankshaft revolution apart through the two revolutions of the crankshaft to complete the required four strokes. It will be noted that the crankshaft 73 is of a type required when the cylinders of each engine have their axes in a common plane normal to the crankshaft axis. If the axes of the cylinders are in planes axially offset relative to the crankshaft, the crankshaft 73A of FIG. 12A is employed.

The four cycle swing beam engine schematically illustrated by FIG. 13 is generally similar to that of FIG. 12, differing only in the manner in which the connecting rods 72B are connected to the crankshaft. While this engine can be perfectly balanced with respect to dynamic forces, it cannot be so balanced with respect to moments. Since all four pistons are shown as reaching top, dead center simultaneously, the required firing order for both two and four cycle engines would be that discussed in connection with FIG. 11. The crankshaft 73B of FIG. 14 may be used when the axes of the cylinders are offset axially with respect to the crankshaft.

FIG. 14 is a two paired beam engine having a block consisting of identical block halves 74 each paired beam power train, represented by the paired pistons II and III and IV, connected to the crankshaft 73B in the previously described manners where the axes of the cylinders are all axially offset with respect to the crankshaft axis.

Figure 15:
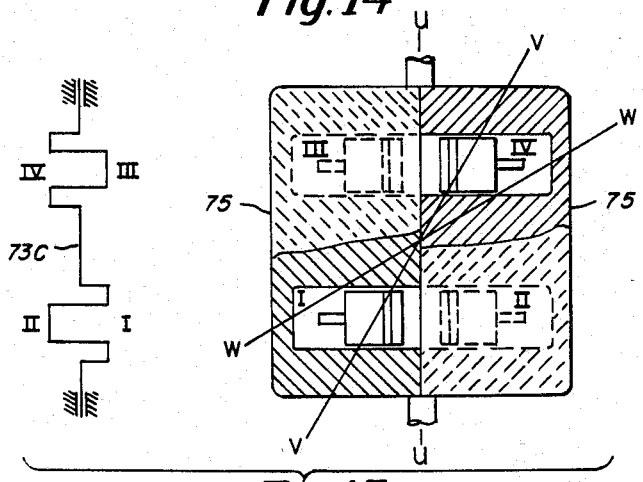
FIG. 15 is a like schematic view of another two paired beam engine with the block consisting of identical halves with opposite cylinders arranged in aligned pairs.

In FIG. 15, a like block consisting of identical block halves 75 is shown for a like four cylinder engine when the axes of the paired pistons I and IV and II and III are each in the same plane with respect to the axis of the crankshaft 73C.

In FIG. 16 another combination of two one paired beam engines 66C is shown having their connecting rods 72C connected to a crankshaft 76 having each of its crank pins angularly spaced 90° apart. This arrangement is particularly well suited for an engine operating in a two cycle mode since each of the four pistons will reach top, dead center 90° apart and thus the firing pulses can be distributed uniformly a quarter of an engine revolution apart. The forces and moments of each engine will be unbalanced but the block axial symmetries about an axis normal to the crankshaft cam still be retained and the resulting block construction advantages retained.

The operation of the several engines will be clear from the descriptions thereof and each has advantages not all of which are afforded by all the others so that each may be preferred over the others for various reasons.

I claim:

1. A paired beam expanding chamber machine such as an internal combustion engine, compressor and pump, said machine including block structure, at least one crankshaft within and rotatably supported by said block structure with its axis in a central transverse plane thereof, said block structure including at least one pair of piston-cylinder units, the cylinder of each unit having one end open and the other end closed to provide a head thereon and at least the open ends of the cylinders on opposite sides of said plane and means to effect intake and exhaust of fluids to and from each cylinder, a pair of links, each link pivotally connected to an appropriate one of said pistons, a pair of beams, said block structure having support surfaces on opposite sides of said plane to each of which one of said beams is pivotally secured, a pair of connecting rod means, one for each unit and operatively connected to said crankshaft, a pair of first pivot means, each connecting one of said beams to an appropriate one of the connecting rod means and a pair of second pivot means, each connecting one end of one of said beams to an appropriate one of said links, said pistons, links, beams and connecting rod means constituting moving paired parts of a power train with the parts of each pair so formed and positioned and an axis of said first and second pivot means so located that in any and all angular positions of said crankshaft, a plane inclusive of the axis of one of the pivot means of whichever one of said first and second pairs thereof that is selected and the crankshaft axis defines an acute angle with respect to a plane inclusive of the axis of the other pivot means of the selected pair and the axis of the crankshaft that does not exceed ±4° and a perpendicular radial distance between the axis of said one pivot means and the crankshaft axis does not differ by more than ±8% with respect to a perpendicular radial distance between the axis of said other pivot means and the crankshaft axis.

2. The machine of claim 1 in which the axes of the cylinders lie in a common plane, the crankshaft has a central crankpin and narrower crankpins, one on each side of the central crankpin, the connecting rod for one beam of said pair of beams carried by the central crankpin, and a pair of connecting rods for the other beam, each of said pair of connecting rods carried by the appropriate one of the narrower crankpins, the combined weight of said pair of connecting rods substantially equal to that of the other connecting rod.

3. The machine of claim 1 in which the block structure includes right and left hand block halves each of which has first and second ends and a face, the faces of the block halves to abut when the block halves are united, the face of each block has a bore adjacent one of said ends which is the cylinder of one of the units, a recess adjacent the other end which is the head of the other of the units and a central recess, the central recesses establishing, when the halves are united, connecting rod passageways and when so united, the bore and the recess of the right hand half are in axial alignment, respectively, with the recess and bore of the left hand half.

4. The machine of claim 3 in which the bores and recesses of the block halves are so located that the two halves are brought into position to be united as by 180° rotation of the right hand half about the crankshaft axis relative to the left hand half and the axes of the units are then aligned with reference to the crankshaft axis.

5. The machine of claim 3 in which the bores are recesses of the block halves and so located that the two halves are brought into position to be united as by a 180° rotation of the right hand half relative to the left hand half about an axis normal to the crankshaft axis and in the central transverse plane when the halves are united, and the axes of the units then axially offset with respect to the crankshaft axis and to each other.

6. The machine of claim 3 in which each block half has a channel opposite the face thereof, each channel has side walls and extends transversely of the crankshaft when the halves are united and each beam extends lengthwise of an appropriate one of the channels and is pivotally connected to the side walls thereof.

7. The machine of claim 1 in which an opposite end of each beam is pivotally connected to the block, and each connecting rod is pivotally connected to the appropriate one of the beams between the ends thereof.

8. The machine of claim 1 in which each connecting rod is pivotally connected to an opposite end of the appropriate one of the beams and each beam is connected to the block between the beam ends.

9. The machine of claim 7 or 8 in which the block structure is unitary and has a central transverse passageway for the crankshaft, opposite faces, each of which includes a pair of spaced walls defining a channel extending transversely relative to the crankshaft passageway, a passageway intermediate each side intersecting the crankshaft passageway and effecting communication between the sides, and a pair of bores, one in each side adjacent an end of the channel thereof, each bore opening in a direction opposite to that of the other bore and the bores located with the intermediate passageway between them, said bores constituting cylinders and their close ends the cylinder heads thereof.

10. The machine of claim 7 in which the central passageway includes ports in the sides of the block, one port dimensioned to receive the crankshaft and a bearing therefor, the other port of increased diameter to enable crankpins to be entered into the block, and a flanged insert attachable to the block and having a port dimensioned to receive the crankshaft and a bearing therefor.

* * * * *